United States Patent [19]

Kennedy et al.

[11] 4,098,064

[45] Jul. 4, 1978

[54] STRAND SHEARING AND DEFLECTING DEVICE

[75] Inventors: Claude A. Kennedy, Moncks Corner, S.C.; Adriano A. Gardella; Ruggero E. Brogi, both of Genoa, Italy; Lorenzo Lavagetto, Genoa-Serra Riccò, Italy

[73] Assignees: Raybestos-Manhattan, Inc., Trumbull, Conn.; Adriano Gardella S.p.A., Genoa, Italy

[21] Appl. No.: 737,404

[22] Filed: Nov. 1, 1976

[30] Foreign Application Priority Data

Dec. 16, 1975 [IT] Italy ..... 12938 A/75

[51] Int. Cl.[2] ..... D01H 9/00; D01H 13/00

[52] U.S. Cl. ..... 57/34.5; 57/76; 83/105

[58] Field of Search ..... 57/34.5, 76; 226/110, 226/199; 83/105, 164; 425/289, 308

[56] References Cited

U.S. PATENT DOCUMENTS 2,097,034 10/1937 Meerdink ..... 57/76 X 2,412,403 12/1916 Jackson et al. ..... 57/34.5

3,430,428 3/1969 Asani et al. ..... 57/76 X

*Primary Examiner*—Richard C. Queisser

*Assistant Examiner*—Charles Gorenstein

*Attorney, Agent, or Firm*—Gary, Juettner & Pyle

[57] ABSTRACT

Process and apparatus are herein described for shearing and alternatively directing a continuously produced strand into or away from a strand collection device, particularly a pot spinning device. The novel apparatus is located between a strand producing unit and a collection unit and includes an elongate upright funnel with a transverse slide at the lower outlet of the funnel. The slide carries a straight tubular section and an angular tubular section, with a cut-off blade between the sections. The slide is reciprocated to bring either of the two sections into register with the outlet of the funnel, with the blade serving to sever the strand as the slide is moved to either position. When the staight section is in register, the strand enters the collection unit. When the angular section is in register, the strand is diverted away from the collection unit. The device is particularly used when operation of the collection unit is interrupted while allowing strand production to continue.

21 Claims, 5 Drawing Figures

STRAND SHEARING AND DEFLECTING DEVICE

BACKGROUND OF THE INVENTION

It is known that asbestos yarns may be produced from asbestos dispersions in a continuous process, by disposing a plurality of nozzles fed with asbestos dispersion within a coagulating bath to form a plurality of individual strands. The individual strands are then combined, removed from the bath, and passed through a zone of low tension wherein the final stages of coagulation can take place; whereafter the thus combined strands are withdrawn as a single strand or yarn and collected, for example, by pot spinning, as described in U.S. Pat. No. 3,806,572.

In order to spin the combined coagulated asbestos strands produced by the aforementioned continuous process, the spinning unit as disclosed in the Italian Pat. No. 896,535 may be advantageously employed. The spinning unit therein described is a centrifugal cup-spinning spindle adapted to collect yarns wound in hollow-core bobbins, and comprises a cup having a neck from which it is suspended for rotation at a high speed about its axis. A tubular, vertically reciprocating distributing thread guide is mounted above the cup and passes through the neck into the cup. An axially stationary, pre-twisting tubular thread guide is positioned coaxially with the distributing thread guide between the latter and an overlying draft unit. The cup and thread guides are supported on a common member and may be mounted as a single unit on the spinning machine frame.

In the aforementioned process, the spindles or pot spinning devices continuously withdraw and collect the wet asbestos strands in a package. Periodically, the operation of the spindle must be interrupted, as for example, to remove a package of yarn when the pot has been filled to capacity. At the same time, it is inconvenient and impractical to interrupt the operation of the strand production unit, primarily due to the problem of the asbestos dispersion clogging in the nozzles. Heretofore, it was necessary for an operator to first manually sever the strand above the spindle and allow it to fall and collect to one side of the apparatus. Upon resumption of pot spinning, the operator would again have to sever the strand and reintroduce it into the inlet of the pot.

Since a large number of individual spindles are employed in a single production line, the foregoing manual operations require a great number of hands and are laborious and time consuming, especiallly since the strands are still wet and are continuously issuing from the coagulating bath. These problems are greatly aggravated, for example, when several spindles are stopped at the same time.

In order to overcome the above difficulties and to improve the efficiency of the spinning and overall operation, the present invention provides for a novel strand shearing and deflecting device to be associated with each one of the spinning units in the path of each asbestos strand to be spun, said device being located between the outlet of the strand production unit and the inlet of the associated spindle. Means are also provided to allow either selective or simultaneous operation of a plurality of such devices, so as to shear either one or several particular strands or all the strands flowing to their respective spinning units, and to deviate the sheared strands to a discharge, whenever the operation of one or more spindles is interrupted. When the spinning is again resumed, the strands are again severed and are redirected into their corresponding spindles.

The device of the present invention is particularly adapted for use with centrifugal pot spinning devices and is capable of handling any interruption in the spinning procedure. The device may be used in connection with all types of asbestos strands, as well as asbestos strands containing fillers or filamentary inserts made of metals, polymers or other materials.

The strand shearing and deflecting device of the invention particularly comprises a funnel element fixedly mounted on the spinning machine frame to guide the newly formed strand into the inlet of a spindle, and a slide mounted at the outlet end of the funnel and carrying on its underside a first straight pipe coaxial with the funnel and a second pipe having a bend therein. A double edge blade is mounted between the first and second pipes on the upper surface of the slide. The slide reciprocates underneath the funnel outlet between a spindle feeding position through the straight pipe and a strand deflecting position through the pipe having the angular bend. During movement of the slide between the two positions, the double edge blade severs the strand, and the severed end of the strand alternatively enters one of the pipe sections. The device thus allows for the deflection of the strand to and from the spindle, while severing the segment that is not collected when the spindle is stopped.

In addition, means are provided to supply a trickle or light flow of liquid down through the funnel during the strand shearing and deflecting procedure, in order to entrain and accompany the sheared strand, thus substituting for the tension ordinarily exerted on the strand by the pot spinning device. The tube of the funnel is sufficiently elongated to accommodate elastic rebound of the severed strand end, thereby preventing unthreading of the strand from the funnel.

THE DRAWINGS

DESCRIPTION OF THE PREFERRED EMBODIMENT

Figure 1:
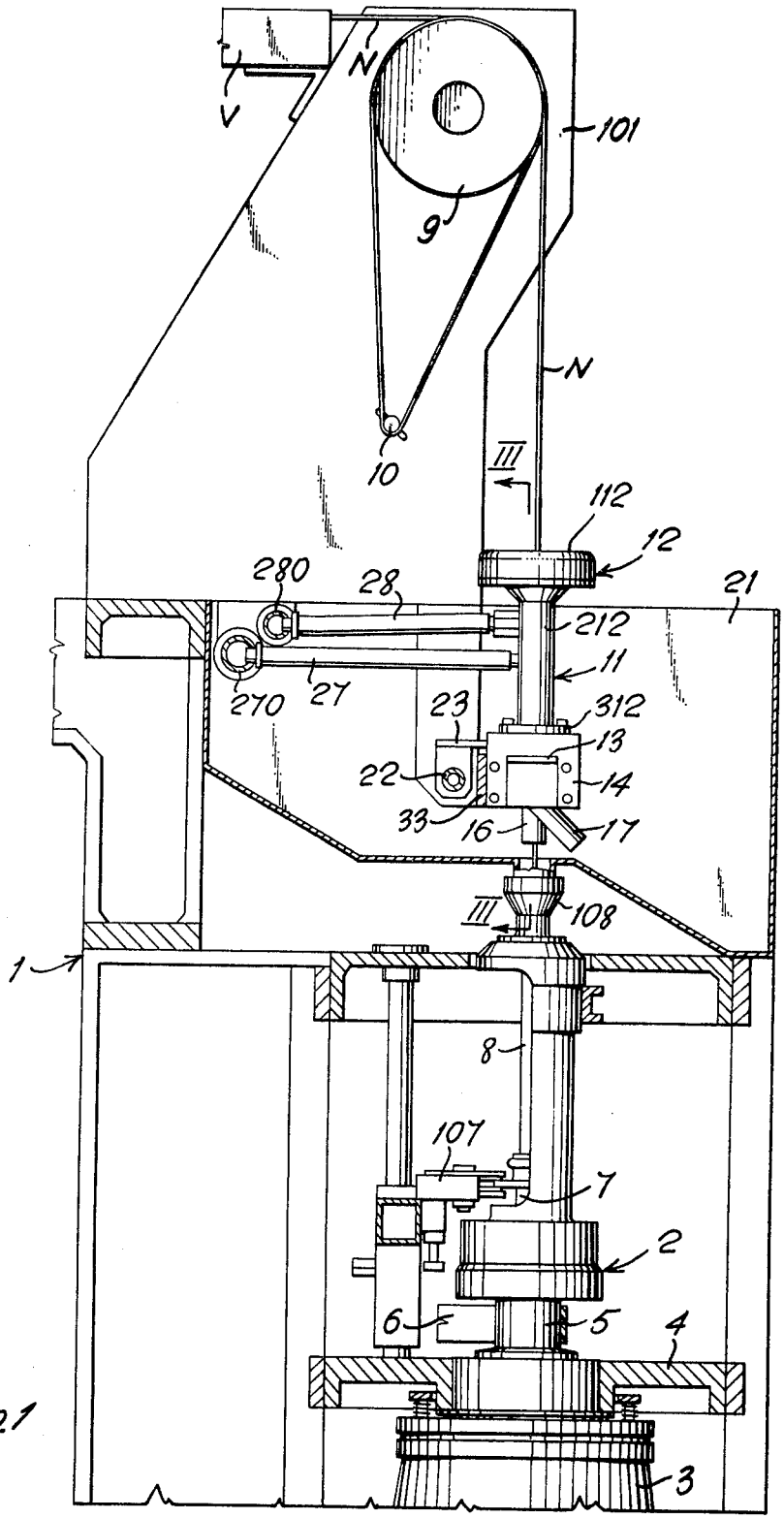
FIG. 1 is a partial side sectional view through a production unit for asbestos yarns, with the strand shearing and deflecting device of the present invention operatively mounted in the path of the strand between the unit continuously producing same and its respective centrifugal cup-spinnning spindle.

Referring to the drawings, numeral 1 denotes the spinning machine frame 1 that supports one or more spindles 2. For the purpose of the invention, the spindles 2 preferably are of the centrifugal pot or cup-spinning type, particularly as disclosed in the specification of the aforementioned Italian Patent. Each spindle 2 comprises a cup 3 rotatably suspended by its tubular neck 5 from bed 4. The cup 3 is driven in rotation at a high speed around a vertical axis by suitable means, such as a driven belt 6 led over a pulley around the neck. A tubular distributing thread guide 7 is coaxially fitted into the cup 3 through the neck 5 and is connected to suitable driven means 107 for vertically reciprocating or moving the guide up and down, in order to distribute the yarn uniformly within the cup. A second stationary thread guide 8 is mounted above and coaxially with the distributing guide 7.

Although only one spindle 2 is shown, it will be appreciated that a number of spindles will normally be mounted in a spaced relation along the frame 1. Associated with each spindle is an apparatus for continuously producing a strand or strands, indicated at N. The strand forming unit, as previously described, comprises a means to feed asbestos dispersion into a coagulating bath V mounted on the top portion 101 of the frame 1. After passage through the bath V, the strand is wrapped over and between a driven Godet roll *g* and a rod 10 spaced from the roll, which allows the strands to flex and cure without imparting substantial tension thereto. It will be appreciated that while the apparatus of the present invention is particularly suitable for wet asbestos yarns, it will be apparent that the apparatus could be modified to accommodate other types of yarns or continuous filaments.

The strand shearing and deflecting device of the present invention is shown generally at 11 and is mounted on the frame 1 in a location between the continuous strand production unit and the spindle wherein the strand N is finally collected.

The device 11 comprises an upright funnel 12 affixed to the frame and having its upper flared opening 112 facing upwardly in a proper position for reciving the strand N from the roll g. The elongated downwardly extending straight tube 212 of the funnel 12 is substantially coaxial with the inlet 108 of the spindle 2.

A slide is mounted at the outlet end of the funnel tube 212 in a stationary housing 14 and is slidable transversely to the longitudinal axis of the tube. The lower end of the tube 212 has a flange 312 to enable attachment to the housing. An annular counterblade 15 is mounted to the housing beneath the flange 312 and extends around the outlet of the tube 212. The blade, housing and flange may be secured together by common bolts as shown. Preferably, the counterblade 15 has a lower cutting edge that slightly projects inwardly and radially toward the geometrical axis of the tube 212.

Secured to the underside of the slide 13 and extending downwardly therefrom are a straight pipe section 16 and an oblique or bent pipe section 17. The pipes 16 and 17 are spaced from one another in the direction of the slide run and communicate with respective openings in the slide. A blade 18 with two opposed cutting edges is mounted on the upper side of the slide 13 between the pipes 16 and 17. The blade 18 is a bar-like member and is slidably supported near its sides upon a pair of spaced bars 118. Each of the bars 118 is movably mounted near its ends on vertical pins 19 affixed to the housing 14. The bars 118 in turn are resiliently supported upon partially compressed spiral springs 20 around the lower portion of the pins, said springs extending between the bars and a lower adjustable nut on the threaded end of each pin. The resiliently supported bars 118 serve to urge the blade 18 into engagement with the counterblade 15 and also serve to support the entire slide assembly in the housing 14. It will be noted that regardless of position, the blade 18 is always supported between the bars 118 and the downwardly facing structure of the counterblade 15 so as to assure smooth and reliable operation of the slide 23. As shown in FIG. 14, the blade 18 is attached to the slide 13 by means of a threaded bolt 218 in a manner to also allow limited vertical adjustment of the blade. The resilient support for the blade and the bolt 218 accommodate for wear between the blade and counterblade.

Figure 3:
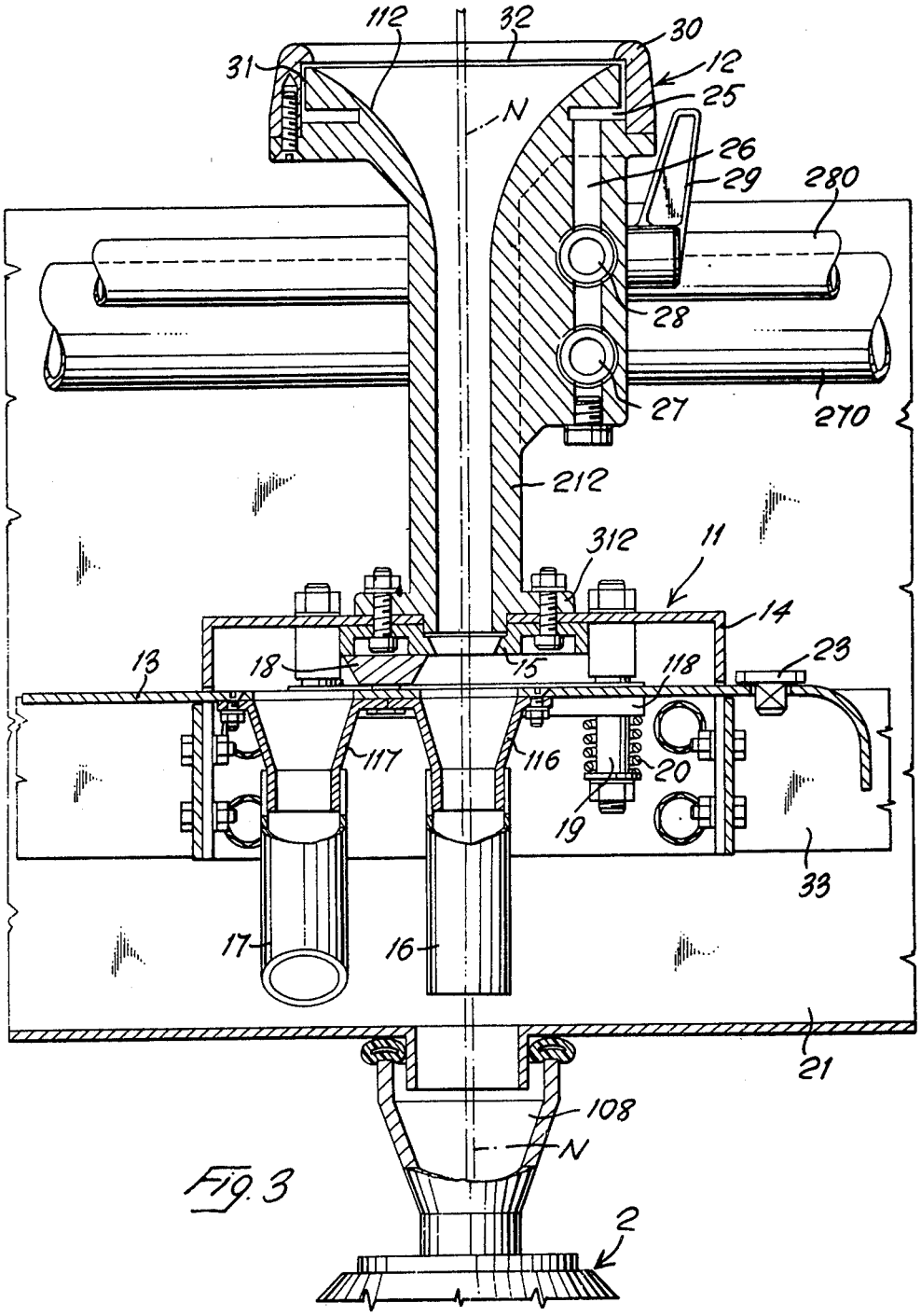
FIG. 3 is a sectional view taken on line III—III of FIG. 1, illustrating the device in its strand feeding position.

When the slide 13 is moved into the spindle feeding position, as shown in FIGS. 1 and 3, the stright pipe section 16 is in axial alignment with the outlet tube 212 of the funnel 12 and with the inlet 108 of spindle 2. The straight pipe section 16, which preferably has a flared inlet, thus serves as a direct conduit for the strand N from the funnel 12 to the spindle, allowing the strand to be collected in the usual manner.

Figure 2:
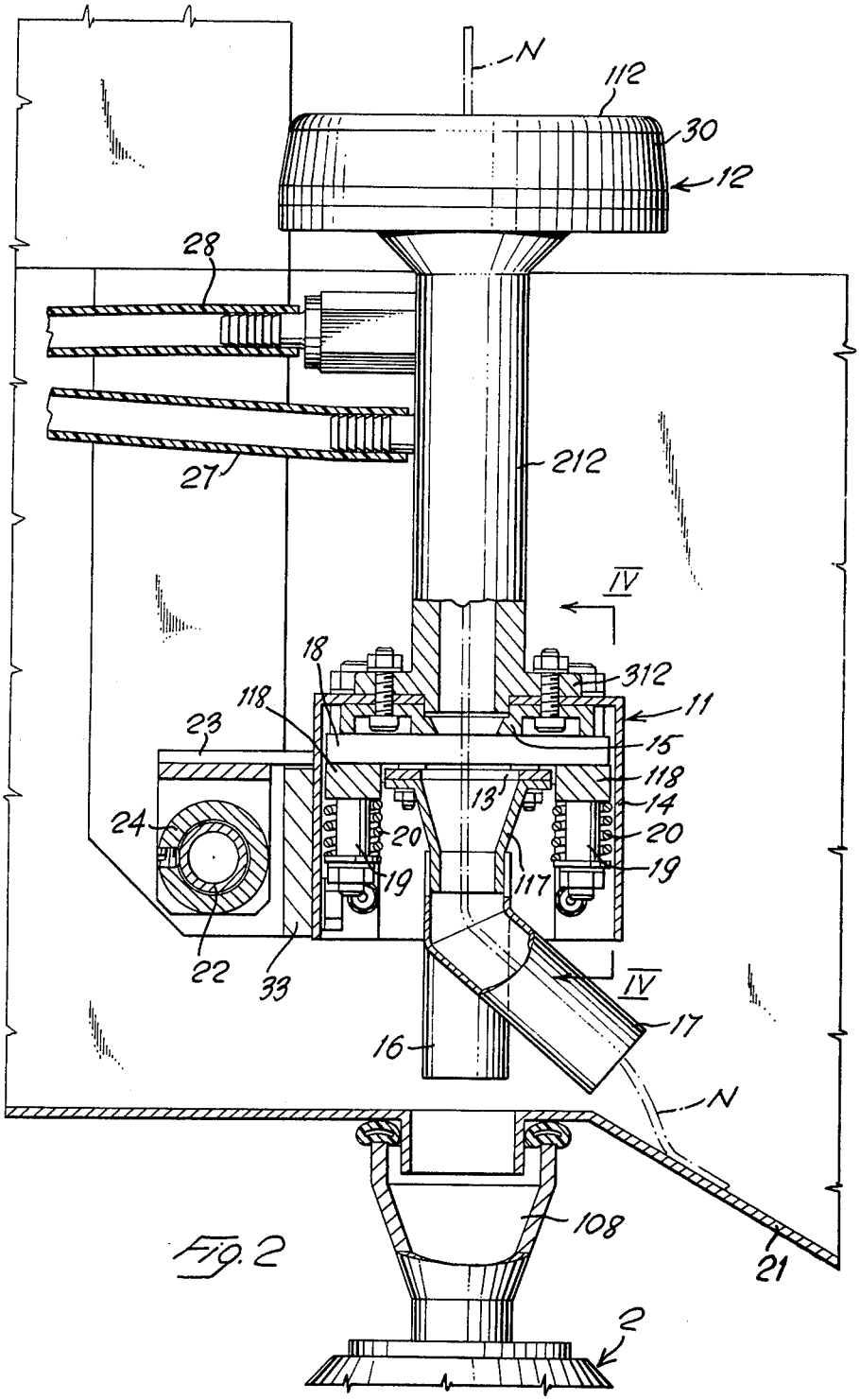
FIG. 2 is an enlarged side view with parts in section showing only the strand shearing and deflecting device of the invention.
Figure 4:
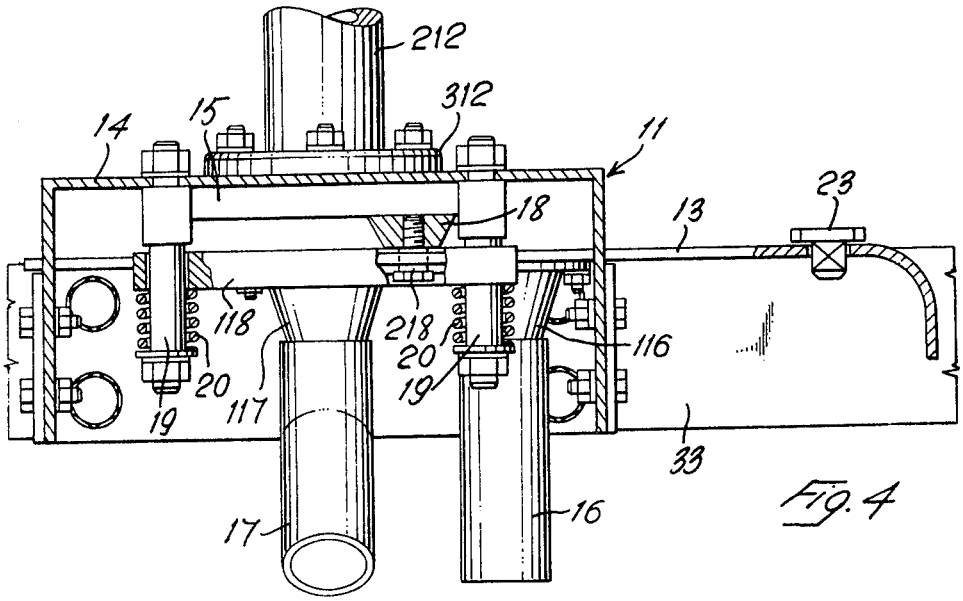
FIG. 4 is a front sectional view taken on line IV—IV of FIG. 2 with the slide of the device in its position to deflect the strand to a discharge.
Figure 5:
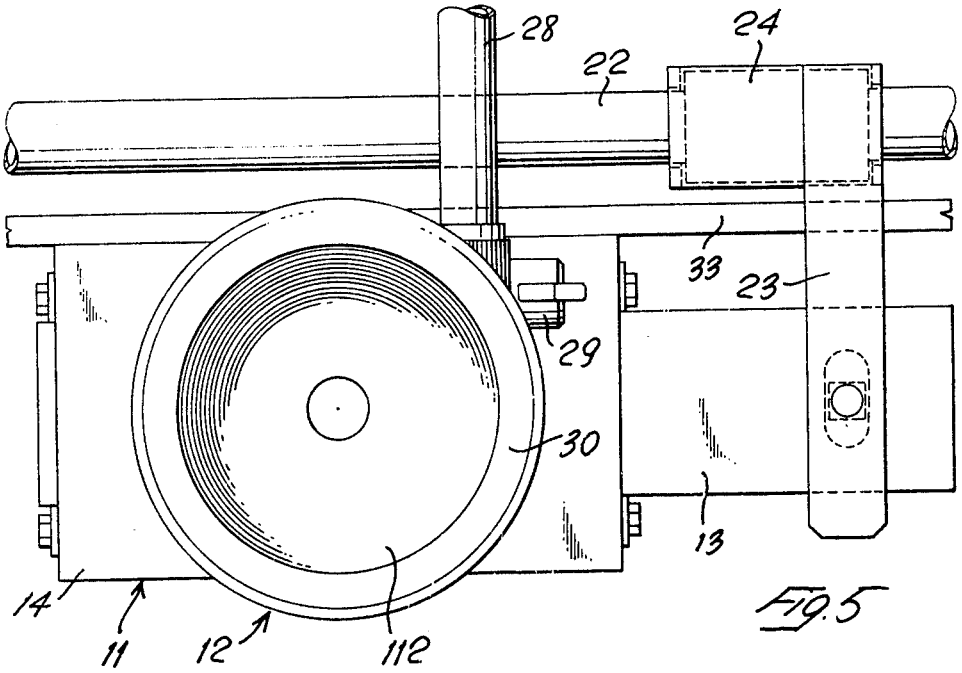
FIG. 5 is a top plan view of the strand shearing and deflecting device of the invention.

When the slide is moved to the strand deflecting position, as shown in FIGS. 2 and 4, the oblique or bent pipe section 17 has its upper flared end in alignment with the outlet 212 of the funnel 12. The strand N is thus diverted away from the spindle 2, and preferably forwardly of the apparatus into a discharge, such as into a compartment 21 associated with the frame 1.

In operation, whenever the slide 13 is moved from its spindle feeding position (FIGS. 1 and 3) to its strand deflection position (FIGS. 2 and 4), one of the cutting edges of the blade 18 intercepts the strand N then moving to the spindle 2 and shears the strand against the corresponding edge of the counterblade 15. The severed end of the strand, which is continuously issuing from the funnel 12 will then be directed into the oblique pipe 17 and thence into the discharge compartment 12. In a like manner, as the slide 13 is returned to its spindle feeding position for resuming the collection by the associated spindle 2, the opposite edge of the blade 18 again shears the strand that was discharging into compartment 21, and the severed end of the strand is again led into the inlet 108 of the spindle 2 through the straight pipe section 16.

Therefore, whenever interruption of the operation of the spindle 2 is required, the strand N will be automatically severed and routed to a discharge, simply by shifting the slide 13 to discharge position. When spinning is to be resumed, the slide is returned to the feed position and the strand will again be directed into the spindle 2.

In usual practice, rotation of the spindle 2 is continued until the cup is filled, whereupon the spindle must be stopped in order to remove the accumulated yarn package. A brake is preferably incorporated in the spindle mechanism in order to stop the spindle as quickly as possible, thus minimizing waste of asbestos yarn that is continuously issuing from the production unit. In order to further minimize waste, the power to the spindle 2 is first shut down, allowing the spindle to decelerate substantially before the slide 13 of the strand shearing and deflecting device is shifted to the strand deflecting position. In this manner, the spindle continues to collect the yarn during part of the period of deceleration. As the spindle decelerates, the tension on the strand N is substantially reduced, thus also reducing the tendency of the strand to spring back when it is severed.

In a normal commercial operation, a plurality of spindles 2 will be mounted on a common support in a line and will each be supplied with individual strand deflecting units. Thus, it is desirable to provide means to simultaneously actuate a plurality of slides. A common driving bar or pipe 22 may be provided lengthwise of the production line, i.e., generally parallel with the slide 13. As desired, any one or more the the slides 13 may be connected to the bar 22 for actuation. For this purpose, one end of an arm 23 is detachably secured to the slide, and the other end of the arm is secured to a hub 24. The hub is rotatably but not slidably mounted on the bar 22, and means (not shown) are provided to drive the bar 22 back and forth to shift one or more of the slides when required. The arm 23 may be detached from and rotated up away from any of the slides 13 if common operation by the bar 22 is not desired.

In the production of an asbestos strand as described herein, the strand is twisted and collected under tension in the spinning pot 2 while the strand is wet, which has several desirable effects, one of which is to greatly minimize emmision of asbestos dust to the surrounding atmosphere. When in a wet condition, however, the strand is fairly limp, and, upon being severed, the free end of the strand, which is no longer under tension might tend to stick to an internal wall of the funnel 12 or in one of the discharge pipes.

In order to facilitate the movement of the strand through the device of the present invention, particularly when or shortly after the strand is severed, means are provided for running a thin stream of water downward and over the internal walls of the funnel 12. As shown in FIG. 3, an annular passageway 25 is formed in the flared inlet portion 112 of the funnel 12. The passageway 25 communicates with an internal duct 26, into which a pair of external branch pipes 27 and 28 are connected. Pipe 27 is connected to a feed line 270 for supplying water simultaneously to a plurality of devices 11, whereas the other pipe 28 or line 280 is fitted with an individual shut-off valve for selectively supplying water only to individual devices 11. Thus, it is possible to feed all devices simultaneously through the common open line 270, or to feed only selected devices through line 280 by opening or closing the corresponding valves 29 as desired.

An annular collar 30 is sealed around the upper rim of the flared inlet portion 112 of the funnel 12, and together with the outer peripheral surface of the inlet, define an annular passage 31 in communication with the passageway 25. The upper end of passage 31 terminates in an annular outlet lip 32 extending around the rim of the funnel inlet 112. Whenever required, water may be supplied through line 270 or 280, as the case may be, and a trickle of water will be discharged around the annular lip 32 and will flow down and entirely cover the internal walls of the funnel. The water flow prevents the freshly severed strand from sticking in the funnel, and the water also serves to entrain and guide the severed, limp strand through and out to the funnel tube 212.

It may be seen that the funnel 12 performs several important functions, one of which is to guide the strand directly into one of the pipe sections 16 or 17 and to provide a surface at its lower edge against which the strand N may be effectively sheared. As mentioned previously, the funnel is sufficiently elongate to accommodate the spring-back of the yarn when it is severed, and a flow of water down the funnel is provided to continue the movement of yarn therethrough after being severed and when not connected to the spinning unit.

Furthermore, it should be noted that the strand shearing and deflecting devices 11 are mounted onto bar 33 so as to be cantilevered therefrom. Moreover, the strand discharge and collection compartment 21 is common to all the units 11 in the spinning frame, and the feed lines 270 and 280, as well as branch pipes 27 and 28 leading into their respective strand shearing and deflecting device 11, are enclosed in said frame. Therefore the assembly is considerably compact, which greatly facilitates adaption of the assembly to any type of spinning frame without substantial modification.

Having thus described a preferred embodiment of the invention, it will be understood that various additions or modifications may be made thereto without departing from the scope and the spirit of the appended claims.

We claim:

1. Apparatus for alternatively feeding or diverting a continusouly produced strand to or from a location where the strand is to be collected said apparatus comprising the combination of a first conduit means for guiding the strand toward said location, said first conduit means having an outlet spaced from said location, second conduit means movable into registry between said outlet for guiding the strand from said first conduit means to said location, third conduit means movable into registry with said outlet for guiding said strand away from said location, means for alternatively moving either of said second or third conduit means into registry with said outlet, and means for severing said strand at said outlet upon movement of either of said second or third conduit means into registry with said outlet.

2. The apparatus of claim 1 wherein said first conduit means comprises an upright funnel, the upper flared end thereof receiving said strand, and the lower tubular end thereof constituting said outlet.

3. The apparatus of claim 1 wherein said second conduit means comprises a straight pipe section.

4. The apparatus of claim 1 wherein said third conduit means comprises a pipe section having an oblique bend therein.

5. The apparatus of claim 1 wherein the means for alternatively moving either of said second or third conduit means into registry with said outlet comprises a member connecting said second and third conduit means in a spaced relationship, and means supporting said member for reciprocating movement at said outlet.

6. The apparatus of claim 1 wherein the means for severing said strand comprises a cutting device located between said second and third conduit means.

7. The apparatus of claim 5, wherein said member is a linear slide and said second and third conduit means depend from said slide in a linear spaced relationship.

8. The apparatus of claim 7 wherein said means for severing said strand comprises a double edge blade mounted on the top of said slide between said second and third conduit means.

9. The apparatus of claim 8 wherein a counterblade is mounted around the outlet of said first conduit means, said double edge blade coacting with said counterblade upon movement of said double edge blade in either direction.

10. The apparatus of claim 9 wherein means are provided for resiliently urging said double edge blade against said counterblade.

11. The apparatus of claim 1 further comprising means for flowing water through said first conduit means.

12. In combination with apparatus for continuously producing a strand from a production unit and collecting the strand in a collection unit below the production unit, an apparatus for shearing and deflecting said strand toward and away from said collection unit, said apparatus comprising an upright funnel receiving the strand from the production unit, an outlet at the lower end of said funnel spaced from the collection unit, and a slide mechanism between said outlet and said collection unit, said slide mechanism comprising a slide movable transversely to the axis of the funnel, said slide being movable between a collection unit feeding position and a diverting position, a pair of spaced pipes depending from said slide, the inlets of respective pipes being alternatively in registry with the outlet of said funnel with said slide in its respective positions, one of said pipe sections being straight and communicating with said collection unit with said slide in feeding position, the other of said pipes having a bend therein leading away from said collection unit with said slide in said diverting position, and means associated with said slide for severing said strand upon movement of said slide from one position to another.

13. The combination of claim 12 wherein the means for severing said strand comprises a double edge cutting blade mounted on the upper surface of said slide between said pair of pipe sections, the respective edges of said cutting means facing generally toward the respective inlets to said pipes.

14. The combination of claim 13 wherein a counterblade is is provided at the outlet of said funnel, said double edge cutting blade being slidably engageable with said counterblade to sever said strand.

15. The combination of claim 13 further comprising resilient support means for supporting said double edge blade and urging said blade against said counterblade.

16. The combination of claim 15 wherein said resilient support means comprises a pair of spaced bars slidably supporting said double edge blade near the ends thereof, and spring means for supporting said bars.

17. The combination of claim 12 further comprising discharge means for discharging a limited flow of water down through said funnel, said discharge means comprising an annular outlet lip near the upper rim of the funnel, and means for supplying said lip with water.

18. The combination of claim 17 wherein the means for supplying said lip with water comprises an internal chamber in said funnel communicating with said lip, and an external water supply line connected to said chamber.

19. The combination of claim 18 wherein a pair of external supply lines are connected to said chamber, and a shut-off valve is connected in one of said lines.

20. The combination of claim 12 further comprising means for moving said slide between said feeding and said diverting position, said last mentioned means comprising a driving member supported in parallel to said slide, and an arm extending from said member and being detachably connected to said slide.

21. The combination of claim 12 wherein the length of said funnel is sufficient to accommodate elastic spring-back of said strand after being severed.

* * * * *